United States Patent [19]

Moore

[11] Patent Number: 4,744,310

[45] Date of Patent: May 17, 1988

[54] BALE TIE BLANKET

[75] Inventor: Harry O. Moore, Charlotte, N.C.

[73] Assignee: Hal F. Whisnant, Charlotte, N.C. ; a part interest

[21] Appl. No.: 103,199

[22] Filed: Oct. 1, 1987

[51] Int. Cl.[4] ..... E06B 9/00

[52] U.S. Cl. ..... 109/49.5

[58] Field of Search ..... 109/49.5; 74/608; 128/132 D; 428/100

[56] References Cited

U.S. PATENT DOCUMENTS 2,407,049 9/1946 Winarsky ..... 109/49.5

2,418,055 4/1947 Smith ..... 109/49.5

3,801,416 4/1974 Gulbierz ..... 109/49.5

*Primary Examiner*—Robert L. Wolfe

*Attorney, Agent, or Firm*—Clifton Ted Hunt

[57] ABSTRACT

A blanket of heavy fabric is provided as a protective device to prevent injury to workers while cutting straps on a compressed bale of cotton or the like. The blanket has a rigid frame providing an access opening between two sections of the blanket. When the portions of the straps in the opening are cut, the frame and proximal sections of the blanket prevent injury to workers by confining the cut straps between the bale and the blanket. One surface of the blanket is textured for adherence of the blanket to the bale.

12 Claims, 2 Drawing Sheets

BALE TIE BLANKET

FIELD OF THE INVENTION

This invention relates to the protection of workers from injury by cut straps while cutting the straps that bind the contents of compressed bales, such as cotton bales.

BACKGROUND OF THE INVENTION

Commodities such as cotton and paper are customarily packed in bales which are compressed and tied or strapped under heavy pressure. As many as five straps are used to hold together under pressure a bale of cotton measuring approximately 57"×45"×28" and weighing about 500 pounds. The bales are opened by cutting the straps which extend circumferentially around the bale. The cutting of the straps is universally accomplished with wire cutters or an axe. Wire cutters, when used, are preferably longhandled to enable the worker to be as far as possible from the explosive backlash of the straps when they are cut. Many workers have been injured by the backlash of the straps when they were too close to the straps being cut.

SUMMARY OF THE INVENTION

It has been found that the dangerous backlash inherently experienced when cutting the straps on compressed bales can be controlled by placing a protective blanket over the bale before the straps are cut. The blanket absorbs the energy of the backlash and virtually eliminates the danger of being injured by the straps when cut. The blanket includes an open window to provide access to the straps between two sections of the blanket.

DETAILED DESCRIPTION OF THE INVENTION

Referring more specifically to the drawings, the numeral 10 indicates a bale of a compressed substance such as cotton or paper. The invention is described in connection with a bale of cotton, but it is to be understood that the invention is useful to protect against injury when cutting the straps on a compressed bale of any substance.

The bale 10 is formed by compressing in a known manner a quantity of a substance under high pressure (about 2,000 pounds being commonly used) and holding the contents of the compressed bale together with a plurality of circumferentially extending straps 11. An average size cotton bale, which is about four and a half feet long, is customarily bound with five straps spaced along the length of the bale.

Figure 1:
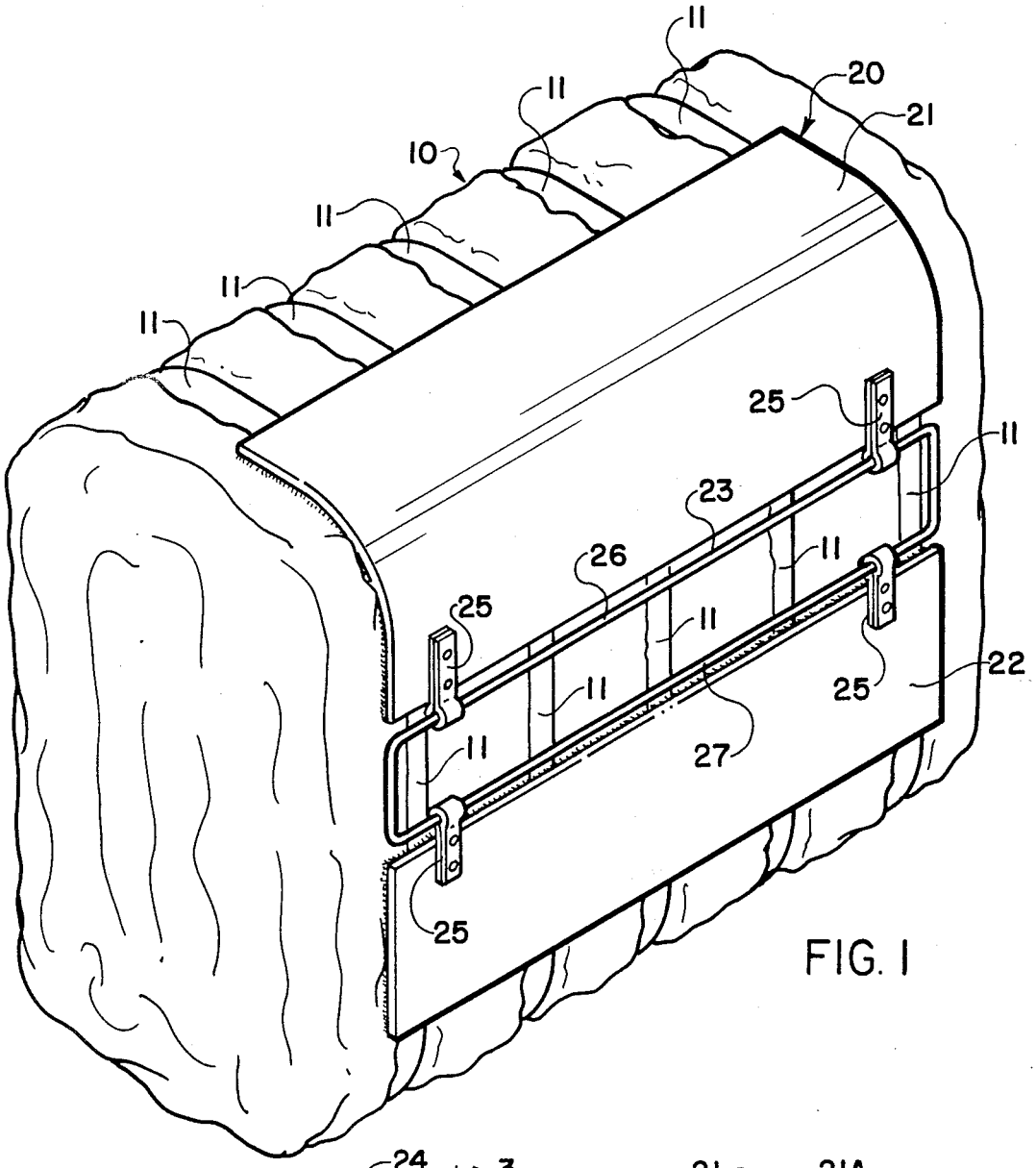
FIG. 1 is a perspective view of the blanket positioned on a bale of cotton lying on its side; .
Figure 2:
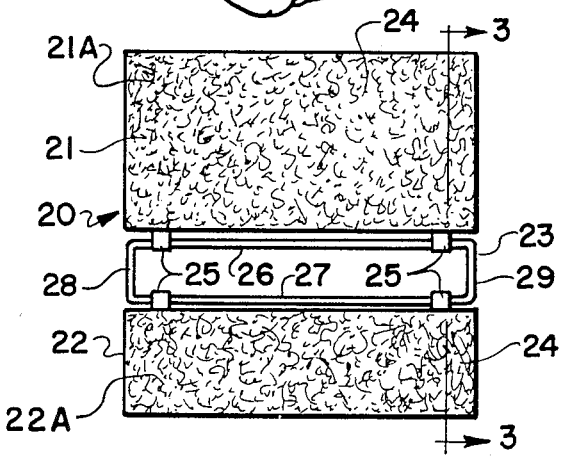
FIG. 2 is an inverted plan view of the blanket removed from the bale.
Figure 3:
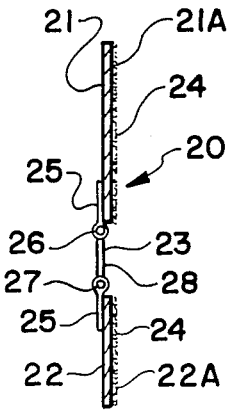
FIG. 3 is a sectional view taken substantially along the line 3—3 in FIG. 2.
Figure 4:
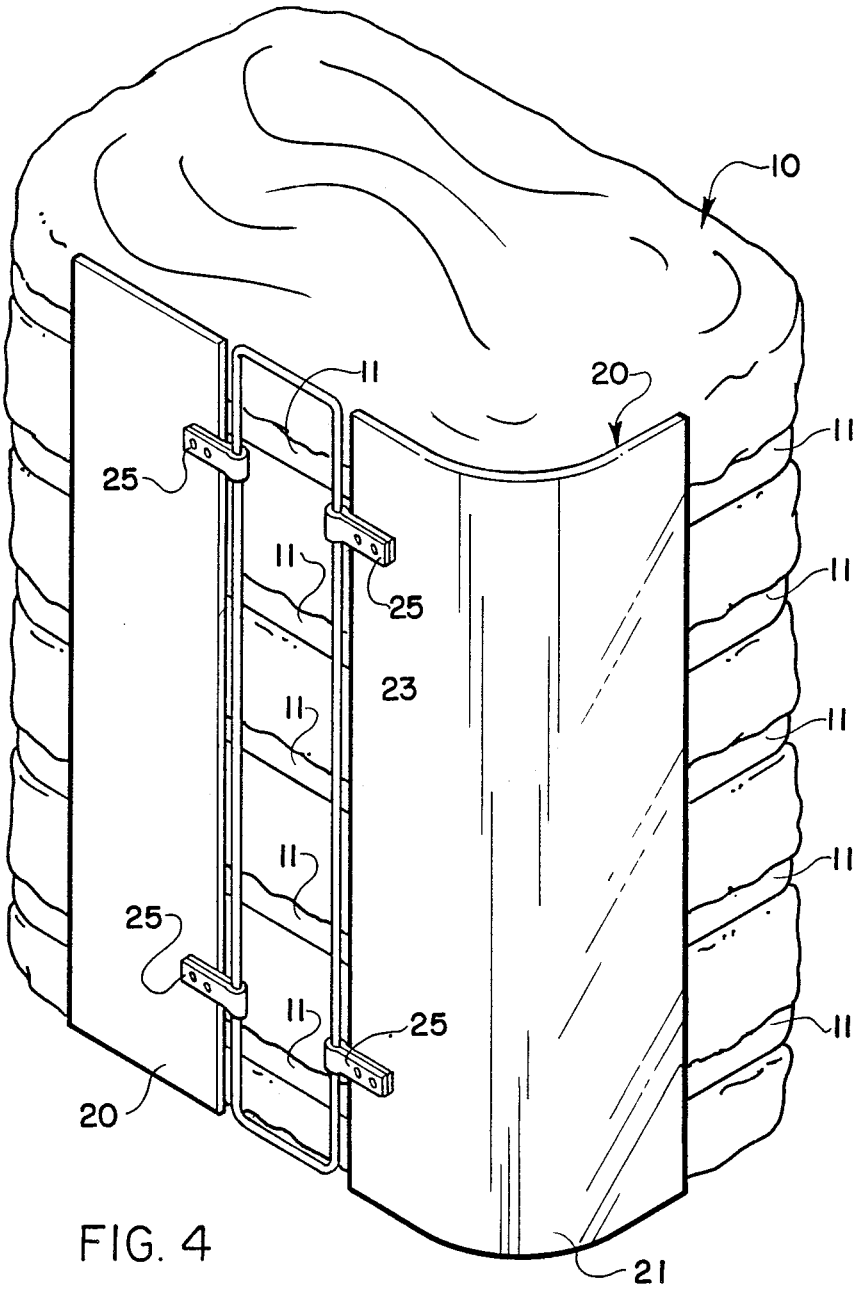
FIG. 4 is a perspective view illustrating the blanket positioned beside a bale of cotton standing on end.

The bales are shipped to their destination and each bale is opened by manually cutting the straps with an axe or with long handled wire cutters while the bale is lying on its side, as in FIG. 1, or on one end, as in FIG. 4. The ends of the straps lash out violently when cut, endangering the worker and anyone else within several feet of the barrel.

The risk of injury from the cut straps is minimized by the use of a protective blanket, broadly indicated at 20. The blanket 20 includes sections or pieces of fabric 21 and 22 connected to opposite sides of a rectangular metal frame 23. The sections 21 and 22 may be made of any heavy fabric which is self supporting but pliable, such as carpet, canvas, or rubberized fabric of the type used as belting for conveyors, for example.

The blanket 20 is long enough to cover all of the straps on a bale, and wide enough to substantially cover one side of the bale. The section 21 of the blanket is wider than its section 22 and extends around one corner of the bale to provide support for the blanket on the bale, particularly when the bale is on its side as in FIG. 1. The narrower section 22 is wide enough (about 12 to 18 inches) to dampen the cut straps but made no wider than necessary to lessen the weight of the blanket so it can be easily handled by one worker.

The inner surfaces 21A and 22A of the heavy fabric sections 21 and 22 may be textured as at 24 to provide a surface which will cling to the contents of the bale and readily support the blanket on the bale without attention from the worker. The texturing may be a series of hooks or any irregularities that will adhere to the cotton when the blanket is pressed against it.

The sections of heavy fabric 21 and 22 are connected by hinges 25 to sides 26 and 27 of the frame to readily conform the blanket to the contour of the bale without attention of the worker when the blanket is placed on the bale as in FIG. 1, or placed against the bale as in FIG. 4.

End pieces 28 and 29 of the frame 23 extend between the sides 26 and 27 and space the sides apart to provide access to the straps on a bale so they can be cut. The frame 23 is coextensive in length with the fabric sections 21 and 22 and long enough that the opening or window defined by the frame 23 extends beyond the endmost straps 11 when the blanket is positioned about a bale as in either FIG. 1 or FIG. 4, providing access to all of the straps on a bale so they can be cut without the need to reposition the blanket on the bale. The end pieces 28 and 29 are preferably no more than twelve inches long so that the sides of the frame and the heavy fabric sections 21, 22 are close enough to the area of cutting to provide the desired coverage and dampening of the straps 11 when they are cut. The end pieces 28 and 29 serve as convenient handles for one worker to carry the blanket and position it about a bale.

With the blanket positioned against the bale as in FIGS. 1 or 4, the straps 11 are cut in sequence and the blanket 20 confines the cut ends of the straps 11 between the bale and the blanket without attention from the worker. The blanket 20 thus prevents the cut ends of the straps from flying dangerously outwardly from the bale, and protects the worker from injury. After the straps are cut, the blanket is moved to the next bale to be opened.

There is thus provided a blanket which can be installed in operative position on a bale with a minimum of effort and which will protect workers from being injured by the cut straps while opening compressed bales.

I claim:

1. A protective device for preventing injury from cut straps while opening a compressed bale of a substance held together by a plurality of straps extending circumferentially around the bale under pressure and spaced from each other along the length of the bale, said protective device comprising means covering the straps on at least one side of the bale and limiting outward movement of the straps relative to the bale when the straps are cut, and said means having an opening therethrough providing access to the straps beneath said means, whereby the straps beneath said means may be cut.

2. A protective device according to claim 1 wherein said means is a flexible blanket comprising two sections and the opening is defined by a rigid frame between the two sections of the flexible blanket, and hinge means connecting the two sections of the flexible blanket to the frame.

3. A protective device according to claim 2 wherein at least one side of the blanket is textured for adherence to the bale.

4. A protective blanket to prevent injury from cut straps while opening a compressed bale of a substance held together by a plurality of straps extending circumferentially about the bale under pressure and spaced from each other along the length of the bale, said blanket comprising two sections of fabric large enough to cover at least one side of the bale, and a rectangualar frame between the two sections of the blanket and defining an opening providing access to the straps beneath the blanket.

5. A protective blanket according to claim 4 wherein the frame is long enough to extend beyond the endmost straps on a bale, the frame is wide enough to provide access to the straps for cutting and narrow enough to permit the sections of the blanket to overlie the cut end portions of the straps and confine them between the bale and the blanket to protect the worker from injury.

6. A protective blanket according to claim 4 wherein one section of the blanket is wider than the other section and at least one side of the blanket is textured for adherence to the bale.

7. A protective device for preventing injury from cut straps while opening a compressed bale of a substance held together by a plurality of straps extending circumferentially around the bale under pressure and spaced from each other along the length of the bale, said protective device comprising a blanket of a length sufficient to extend over all of the straps and of a width sufficient to extend over one side of the bale, and said blanket having an opening providing access to all of the straps when the blanket is operatively positioned on a bale to be opened.

8. A protective device according to claim 7 wherein said blanket is a flexible self-sustaining heavy fabric and contains a frame definining said opening.

9. A protective device according to claim 8 wherein said frame is rigid and includes end pieces which function as handles.

10. A protective device according to claim 9 which includes hinges between the flexible blanket and the rigid frame.

11. A protective device according to claim 7 wherein at least one side of said blanket is textured for adherence to the bale.

12. A protective device according to claim 7 wherein the opening is wide enough to provide access to the straps for cutting and narrow enough that the proximal portions of the blanket cover the end portions of the cut straps to limit outward movement of the cut straps relative to the bale.

* * * * *